United States Patent [19]

Reighart, II

[11] 4,258,912

[45] Mar. 31, 1981

[54] TORNADO NOVELTY DEVICE

[76] Inventor: Ray R. Reighart, II, 4778 Hillcrest North, Hilliard, Ohio 43026

[21] Appl. No.: 113,708

[22] Filed: Jan. 21, 1980

[51] Int. Cl.[3] ..... A63J 33/42; A63J 5/00

[52] U.S. Cl. ..... 272/8 D; 40/408

[58] Field of Search ..... 272/8 R, 8 D, 8 N; 40/406, 407, 408

[56] References Cited

U.S. PATENT DOCUMENTS

| | | | |
|---|---|---|---|
| Re. 23,612 | 1/1953 | Abel | 46/1 R |
| 1,782,944 | 11/1930 | Stanford et al. | 40/407 |
| 1,796,566 | 3/1931 | Herbst | 272/8 D |
| 2,032,192 | 2/1936 | Wheeler, Jr. | 40/408 X |
| 2,589,757 | 3/1952 | Williams | 272/8 R X |
| 3,372,873 | 3/1968 | Weiss et al. | 272/8 D X |
| 3,589,044 | 6/1971 | Morrison et al. | 40/407 |
| 3,695,607 | 10/1972 | Stouffer | 272/8 D |

*Primary Examiner*—George J. Marlo
*Attorney, Agent, or Firm*—Frease & Bishop

[57] ABSTRACT

A novelty device for producing a liquid vortex which simulates a tornado in a transparent circular-shaped chamber which is mounted on top of a housing and filled with a liquid. A flexible bag is mounted within the housing and is divided into upper and lower liquid storage chambers which are connected by a one-way check valve that permits liquid to flow only from the lower chamber into the upper chamber. A fluid passage extends between the upper chamber and the vortex chamber and enters the vortex chamber through a discharge opening in a tangential direction along the outer periphery of the base of the vortex chamber. A drain opening is formed in the base of the vortex chamber and is connected to the lower chamber by a drain passage. A spring-actuated lever is mounted within the housing and engages the upper storage chamber to collapse the chamber and pump the liquid into the vortex chamber to produce the vortex. When the device is at rest in an upright position, the lower chamber of the bag and the vortex chamber are filled with liquid. To actuate the device, it is turned upside down and vigorously shaken. This causes the liquid to flow from the lower chamber into the upper chamber, which expands the upper chamber cocking the lever. Immediately upon righting the device, the spring forces the lever against the upper chamber which collapses the upper chamber forcing the liquid therein into the vortex chamber creating a tornado-like vortex turbulence in the chamber above the drain opening.

18 Claims, 20 Drawing Figures

TORNADO NOVELTY DEVICE

BACKGROUND OF THE INVENTION

1. Field of the Invention

The invention relates to a novelty device, and in particular, to a device which, when shaken by the user, produces a liquid vortex in a transparent chamber filled with liquid which simulates a tornado, and in which a simulated landscape scene may be constructed within the chamber to provide a pleasing and interesting visual effect to a viewer.

2. Description of the Prior Art

Numerous devices have been constructed and produced which are intended primarily for the entertainment of the user by providing an interesting or unusual visual effect or action within the device. Many of these types of devices use liquid as one of the main elements for achieving the desired visual effect. For example, U.S. Pat. Nos. 1,796,566, 2,589,757, Re. 23,612, and 3,695,607 all show various novelty devices using liquid to achieve an interesting visual effect or action. U.S. Pat. No. 3,372,873 is not a novelty device, but is a large commercial mechanism used for producing a vortex or smoke rings by a movable diaphragm for atmospheric testing purposes. This vortex-producing apparatus is the most pertinent prior art known by applicant with respect to the tornado-simulating device described below, which uses a liquid vortex to achieve the desired visual effects.

SUMMARY OF THE INVENTION

Objectives of the invention include providing a novelty device which is adapted to be turned upside down and vigorously shaken which, when righted, produces a simulated tornado in a transparent, liquid-filled, dome-shaped container mounted on top of a main housing to provide an interesting and unusual visual effect; providing such a novelty device in which the vortex-producing mechanism is enclosed in an opaque housing formed of inexpensive plastic with the dome-shaped vortex chamber being mounted on top of the housing; providing such a novelty device in which the liquid used to produce the simulated tornado is water having a foaming agent dissolved therein which when shaken produces a plurality of small bubbles which emphasize the produced vortex, making it visually more perceptible and attractive; providing such a device in which simulated three-dimensional objects, such as houses or trees are formed on the base of the vortex chamber to provide a more realistic landscape over which the simulated tornado is formed, and in which boundary layer control means is provided so that these three-dimensional objects will not cause turbulence in the vortex-forming liquid preventing proper formation of the vortex, which could occur if such boundary layer control were not provided; providing such a novelty device in which a strong vortex is produced in the vortex chamber with a relatively small apparatus by use of a spring and lever mechanism which augments the siphoning action of the liquid when the liquid flows from an upper storage chamber through the vortex chamber and into a lower storage chamber; providing such a device in which the spring and lever mechanism is cocked by the pressure exerted by the liquid contained in the upper storage chamber when the device is turned over and shaken, and in which the spring and lever mechanism has a unique pivotally mounted lever arrangement whereby the mechanism will remain cocked until the device is turned right side up again, whereupon the lever is released from its cocked position and presses against the liquid-filled upper storage container forcibly ejecting the liquid from the chamber and into the vortex chamber producing the simulated tornado; providing such a device in which a unique, simple and inexpensive one-way check valve provides communication between the lower liquid storage chamber and upper liquid storage chamber, whereby liquid will not flow directly from the upper chamber into the lower chamber when the device is right side up; and providing such a novelty device which can be formed of relatively inexpensive, lightweight, sturdy plastic material which uses a foaming agent and water as the liquid medium and which achieves the objectives indicated.

These objectives and advantages are obtained by the novelty device construction for producing a simulated tornado, the general nature of which may be stated as including a first chamber containing a predetermined quantity of liquid; a second chamber communicating with the first chamber; one-way valve means providing communication between the first and second chambers permitting the flow of liquid only from the first chamber into the second chamber; a vortex chamber generally filled with a liquid; liquid inlet passage means extending between the second chamber and the vortex chamber for supplying liquid under pressure from said second chamber into the vortex chamber; drain means extending between the vortex chamber and the first chamber for draining liquid from said vortex chamber into the first chamber; and pump means for forcing liquid from the second chamber through the inlet passage means and into the vortex chamber under pressure and in a trangential direction to form a vortex in the liquid in the vortex chamber communicating with the drain means simulating a tornado.

BRIEF DESCRIPTION OF THE DRAWINGS

A preferred embodiment of the invention—illustrative of the best mode in which applicant has contemplated applying the principles—is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 6:
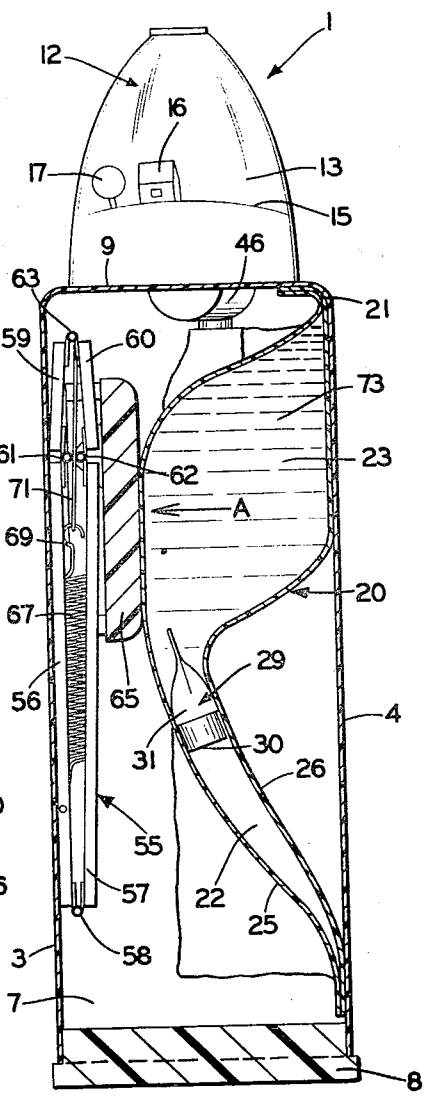
FIG. 6 is a sectional view similar to FIG. 5 with the tornado-producing mechanism shown in an actuated position just prior to producing the tornado effect.

The tornado-producing novelty device is indicated generally at 1, and is shown in complete assembled condition in FIGS. 1–6. Device 1 includes a housing 2 which is formed by spaced, parallel front and rear walls 3 and 4, end walls 5 and 6 and a horizontal top wall 9 which form a hollow interior 7. A pedestal or base 8 encloses the open bottom of housing 2. Housing walls 3–6 and 9 preferably are formed of an integrally molded, lightweight, rugged, opaque or translucent plastic material, and may be in various colors or exterior finishes to provide an attractive appearance to device 1.

A hollow dome-shaped housing 12, formed of a transparent plastic material, is mounted in a fixed position on top wall 9 by an adhesive or may be integrally molded with top wall 9. Housing 12 has a hollow interior which is indicated at 13, and is referred to as the vortex-forming chamber. A base 14, formed of liquid-resistant material, is located within chamber 13 and mounted on housing top wall 9, and is shown particularly in FIGS. 10–13.

Base 14 has a convexly curved top surface 15 and has a landscape painted thereon to depict a particular scene. A simulated three-dimensional house 16 and tree 17 may be mounted on surface 15 to increase the realism of the landscape scene painted on base 14 and housed within vortex chamber 13.

Figure 5:
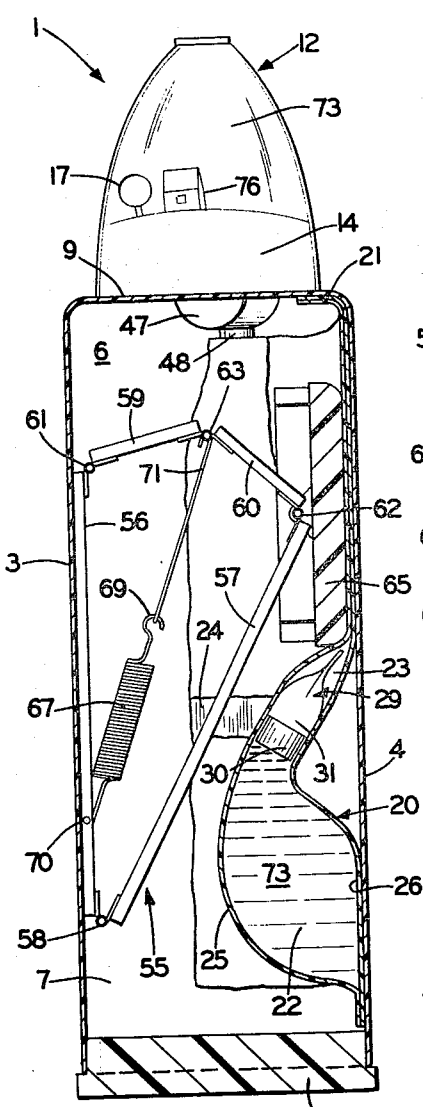
FIG. 5 is an enlarged sectional view taken on line 5—5, FIG. 2, with the internal tornado-producing mechanism shown in a deflated condition.

A flexible bag, indicated generally at 20, is mounted within interior 7 of housing 2 and is attached by an adhesive or other fastening means along its upper edge 21 at the junction of top wall 9 and rear wall 4 (FIGS. 5 and 6). Bag 20 preferably is formed of vinyl or similar flexible, waterproof plastic material and is divided into a lower liquid storage chamber 22 and an upper storage chamber 23. Chambers 22 and 23 are formed by a seam 24 which extends horizontally across the bag generally at its midpoint which may be formed by fusing or bonding bag front wall 25 against bag rear wall 26.

Figure 19:
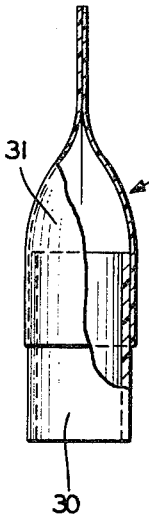
FIG. 19 is an elevational view of the one-way check valve in closed position.
Figure 20:
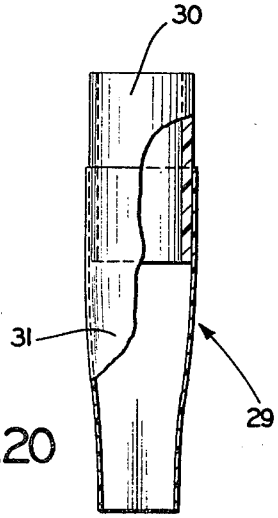
FIG. 20 is an elevational view similar to FIG. 19 showing the check valve in the inverted open position.

A one-way check valve 29 (FIGS. 5, 6, 19 and 20) is mounted in seam 24 to provide liquid communication between lower and upper chambers 22 and 23. Valve 29 is of a simple, inexpensive and unique arrangement consisting of a short section of rigid plastic tubing 30 which is bonded in a fixed position in bag 20 by seam 24. A flexible sheet-like tube-forming member 31 is attached to the end of rigid tube 30 which is located within chamber 23 and forms the outlet for valve 29. This simple valve construction permits the liquid to flow easily from lower chamber 22 into upper chamber 23 when device 1 is inverted (FIG. 20) since the liquid flowing through rigid tube 30 forces flexible tube 31 open. However, when device 1 is placed right side up, (FIGS. 6 and 19) the liquid chamber 23 will collapse flexible tube 31 blocking the flow of any liquid back into lower chamber 22.

Figure 8:
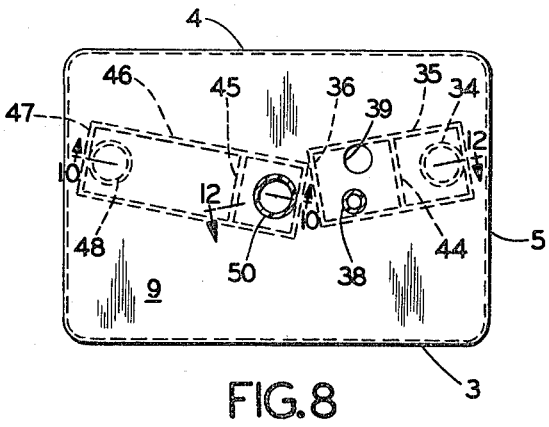
FIG. 8 is a sectional view taken on line 8—8, FIG. 4.

Upper storage chamber 23 communicates with vortex-forming chamber 13 by a vertically extending tube 34. The upper end of tube 34 is connected to an inlet duct 35 which is mounted on the inside surface of housing top wall 9 (FIGS. 8, 9, 11, 12 and 14). The ends of duct 35 are closed by walls 36 and a partition 44 extends from the bottom of duct 35 part way up to the top of the duct and horizontally across (FIGS. 8, 12 and 15). A pair of liquid discharge openings 38 and 39 are formed in housing top wall 9 and communicate with the interior of inlet duct 35 (FIG. 8). Opening 38 communicates with a liquid passage 40 (FIGS. 12 and 17) which extends vertically upwardly through vortex chamber base 14 and into the hollow interior 41 of simulated house 16. A plurality of holes 37 are formed in the upper portion of inlet tube 34 to allow bubbles which may collect at the top of chamber 23 to escape into vortex chamber 13 for forming the simulated tornado therein. Holes 37 also reduce the possibility of blocking the bottom inlet opening of tube 34 by a fold formed in the flexible walls of upper storage chamber 23.

Figure 11:
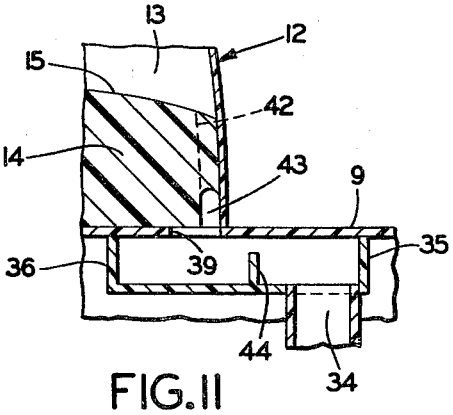
FIG. 11 is an enlarged fragmentary sectional view taken on line 11—11, FIG. 9.
Figure 12:
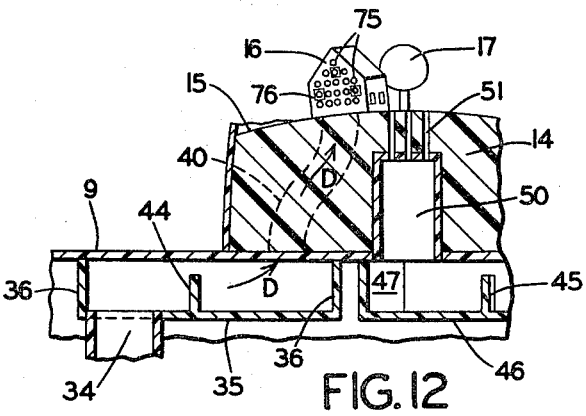
FIG. 12 is an enlarged fragmentary sectional view taken on line 12—12, FIG. 8.
Figure 13:
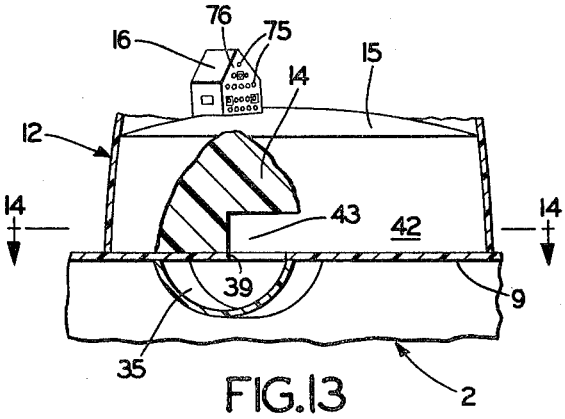
FIG. 13 is an enlarged fragmentary sectional view taken on line 13—13, FIG. 9.
Figure 14:
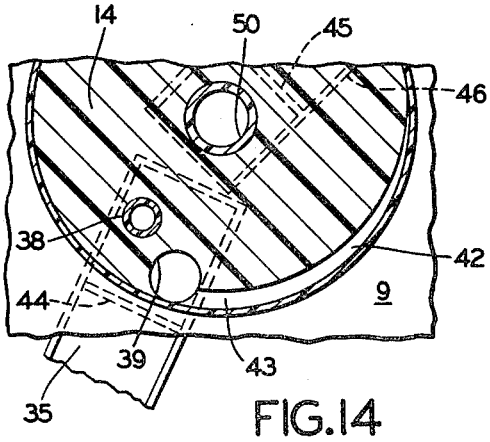
FIG. 14 is a sectional view taken on line 14—14, FIG. 13.
Figure 15:
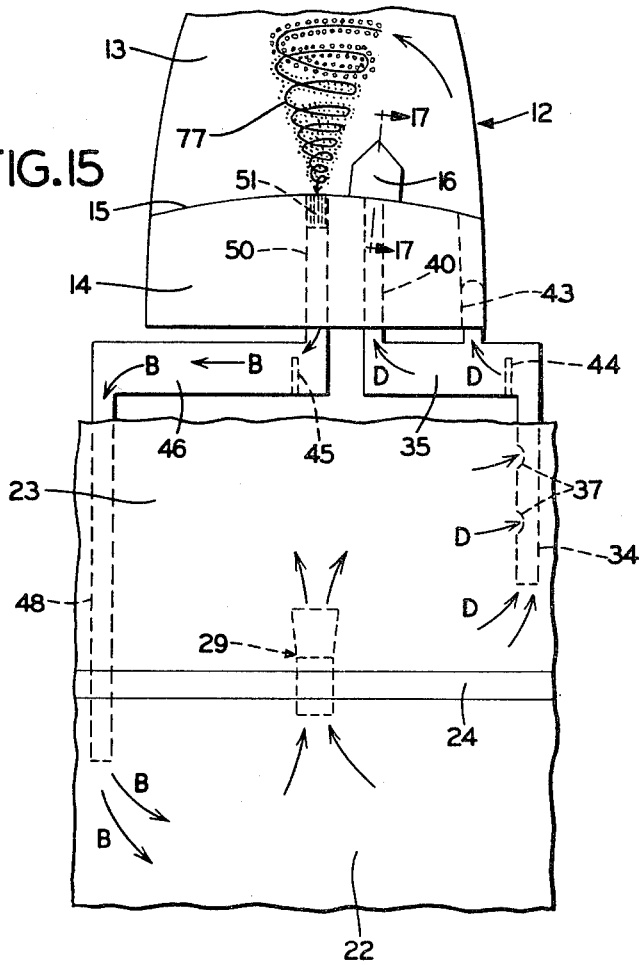
FIG. 15 is a diagrammatic elevational view showing the flow path of the liquid for producing the tornado effect.
Figure 16:
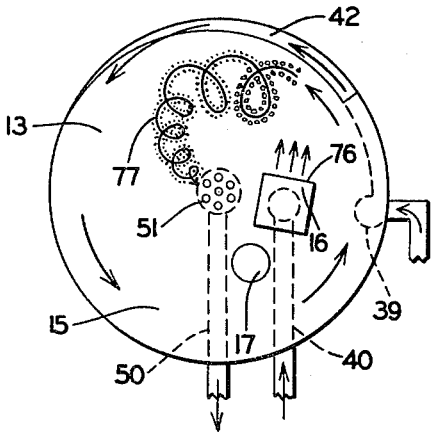
FIG. 16 is a diagrammatic top plan view of the arrangement shown in FIG. 15 showing further details of the liquid flow directions.

Discharge opening 39 communicates with a curved discharge passage 43 which extends for a short distance in a tangential direction within base 14 (FIG. 14) and exits into a curved space 42 which is formed between the outer periphery of base 14 and the inside surface of vortex housing 12 at the bottom of base 14 adjacent the top of main housing top wall 9 (FIGS. 11 and 14). This curved liquid discharge passage which follows the periphery of vortex chamber 13 imparts the whirling or circular directional motion to the incoming liquid to initiate the forming of the liquid vortex or whirlpool effect.

Figure 10:
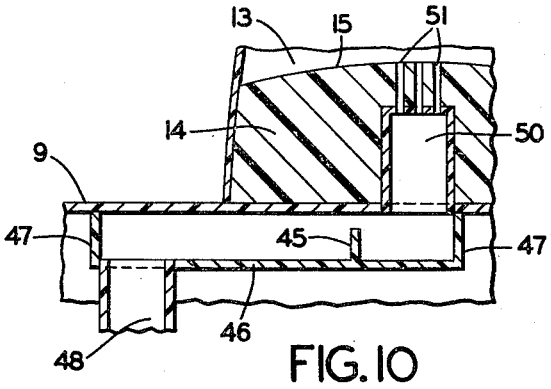
FIG. 10 is an enlarged fragmentary sectional view taken on line 10—10, FIG. 8.
Figure 9:
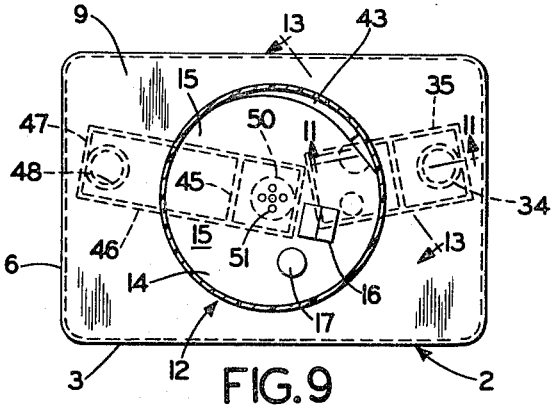
FIG. 9 is a sectional view taken on line 9—9, FIG. 4.
Figure 18:
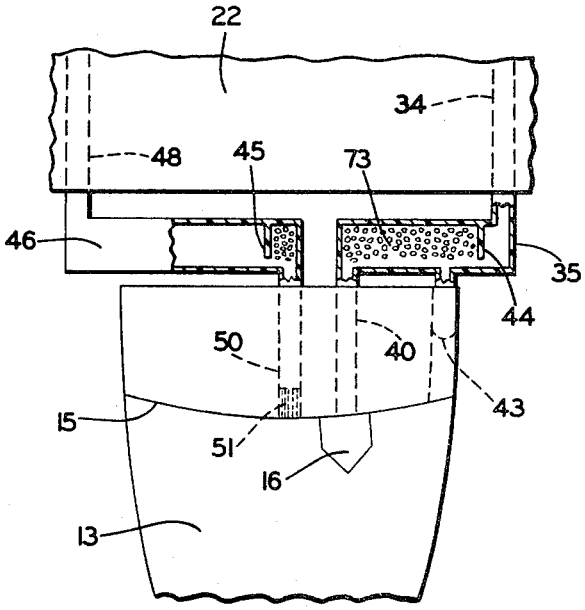
FIG. 18 is a diagrammatic view with portions broken away and in section, showing the partitions in the inlet and drain ducts when the device is in an inverted position.

A drain duct 46, similar to inlet duct 35, is mounted on the inside surface of housing top wall 9 and has end closure walls 47 and a partition 45 similar to inlet duct partition 42. A rigid drain tube 48 (FIGS. 4, 7, 10 and 15) communicates with drain duct 46 and extends downwardly through upper bag storage chamber 23 and communicates with lower storage chamber 22 through an end outlet opening 49. A vertically extending drain tube 50 is formed in base 14 and communicates with drain duct 46 (FIGS. 10 and 12). Drain tube 50 communicates with vortex chamber 13 through a plurality of vertically extending pinlike drain openings 51. Drain openings 51 are located generally in the center of base surface 15. Partitions 44 and 45 trap bubbles in ducts 35 and 46 (FIG. 18) when device 1 is turned upside down so bubbles do not all collect in liquid chamber 22 and 23. Inlet duct partition 44 traps the bubbles in duct 35, whereupon they will flow into vortex chamber 13 immediately when device 1 is turned right side up, before the vortex is formed so as not to interfere with the vortex. Drain duct partition 45 decreases the loss of bubbles from vortex chamber 13 when device 1 is inverted. Thus, more bubbles remain in chamber 13 to improve the appearance of the simulated tornado.

In further accordance with the invention, a spring lever mechanism, indicated generally at 55 (FIGS. 4–6), is mounted within housing interior 7 and is operatively engaged with upper storage chamber 23 of bag 20. Mechanism 55 includes a rigid base plate 56 which is attached by an adhesive or other fastening means to the inside surface of housing front wall 3. A plunger lever 57 is pivotally mounted by a hinge 58 on the lower end of base plate 56 for pivotal movement toward and away from bag 20. A pair of upper lever sections 59 and 60 are pivotally mounted by hinges 61 and 62 to the upper ends of base plate 56 and plunger lever 57, respectively. Lever sections 59 and 60 also are pivotally joined together by another hinge 63.

Figure 4:
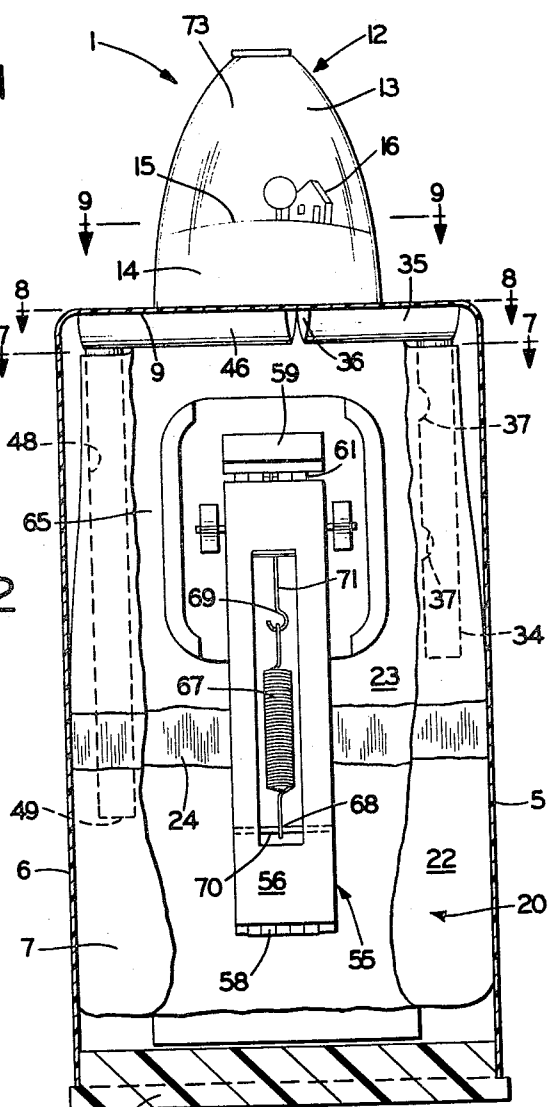
FIG. 4 is an enlarged sectional view taken on line 4—4, FIG. 2.
Figure 1:
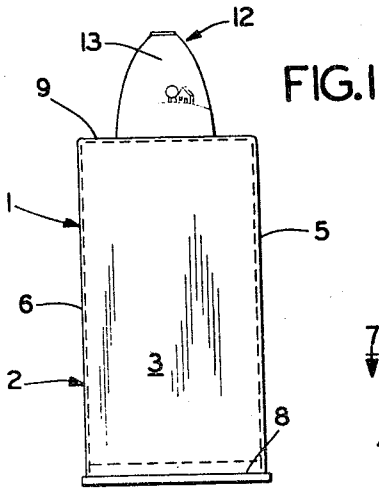
FIG. 1 is a front elevational view of the tornado novelty device.
Figure 2:
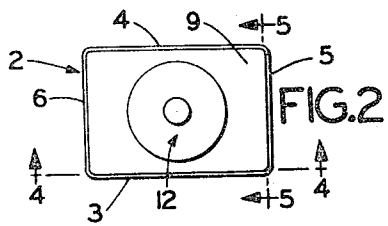
FIG. 2 is a top plan view of the device shown in FIG. 1.
Figure 3:
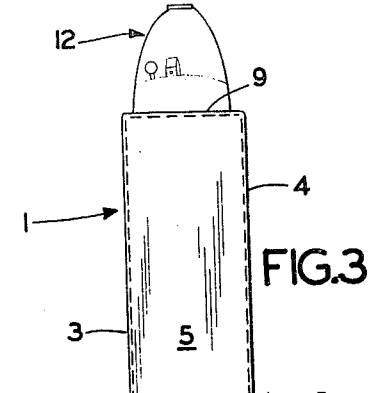
FIG. 3 is a right-hand end elevational view of the device shown in FIGS. 1 and 2.
Figure 7:
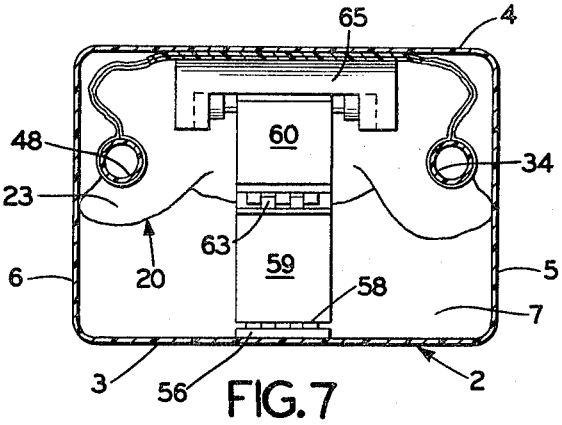
FIG. 7 is a sectional view taken on line 7—7, FIG. 4.

A plunger pad 65 is mounted on the upper end of plunger lever 57 at the junction with lever section 60. Pad 65 has a relatively broad surface area which abuts against the upper storage chamber portion of bag 20, the purpose of which is discussed below. A coil spring 67, formed with a pair of hook ends 68 and 69, provides the biasing force for mechanism 55. Hook end 68 is attached to a bar 70 adjacent the lower end of base plate 56, and hook end 69 is connected to hinge 63 by a tie rod 71 (FIGS. 4 and 5).

Spring 67 exerts a downward force on the joined ends of lever sections 59 and 60 pivotally forcing plunger pad 65 outwardly against bag 20. When mechanism 55 is in the collapsed or "cocked" position of FIG. 6 which occurs upon the filling of upper storage chamber 23 with liquid, the unique arrangement of mechanism 55 requires a very small amount of force to be exerted on pad 65 in the direction of arrow A, for mechanism 55 to remain in this cocked position. When in this cocked position, the horizontal force vector of the spring force is extremely small since the major portion of the spring force is exerted vertically downwardly on hinge 63. However, a very slight outward movement of plunger pad 65 brings the full biasing force of spring 67 immediately into play, forcibly and rapidly moving pad 65 outwardly against bag 20 until mechanism 55 reaches its extended position of FIG. 5. This rapid action is because of the special force versus displacement relationship of the spring and lever due to the particular locations of hinges 61, 62 and 63 and lever sections 59 and 60.

The operation of novelty device 1 is as follows. In its normal upright, at-rest position, device 1 will be in the position shown in FIGS. 4 and 5, with spring-lever mechanism 55 being expanded outwardly, as shown in FIG. 5. In this position, lower storage chamber 22 and vortex chamber 13 are filled with a solution 73 preferably formed of water and a foaming agent, hereinafter referred to as liquid 73. One type of foaming agent found satisfactory is sodium laureth-7 sulfate. Vortex chamber 13 remains filled with this liquid 73 due to the almost complete absence of air trapped within the remaining portions of the self-contained closed liquid system.

To actuate device 1, an individual will invert and vigorously shake the device, which causes the liquid 73 in storage chamber 22 to flow by gravity, in addition to the vigorous shaking action, through check valve 29 and into upper chamber 23. This incoming liquid will cause the chamber-forming bag walls to expand outwardly, which moves plunger pad 65 of spring-lever mechanism 55 to the collapsed or cocked position of FIG. 6. Mechanism 55 will remain in this collapsed position as long as chamber 23 remains filled with liquid and device 1 remains in an inverted position.

Immediately upon device 1 being placed in its upright position on base 8 (FIG. 6), a siphoning action occurs in the fluid system, drawing liquid 73 from vortex chamber 13 through drain holes 51, drain tube 50, drain duct 46 and drain tube 48 into emptied lower chamber 22, as indicated by arrow B in FIG. 15. This drawing of liquid from vortex chamber 13 is immediately replaced by liquid 73 flowing from filled upper chamber 23 through inlet tube 34, duct 35, discharge passage 43 and fluid passage 42. A slight reduction in the volume of liquid within upper chamber 23 releases the relatively small amount of retaining pressure exerted on pad 65 which was required to keep mechanism 55 in its cocked position. The full biasing force of spring 67 then is exerted on pad 65 forcing it in an outward direction against upper chamber 23. This pressure acts as a pump and pumps the liquid contained in chambers 23 forcibly through discharge passage 43 of vortex base 14 and tangentially into the curved discharge space 42, which creates the desired whirling pumping action in the liquid within vortex chamber 13. This injection of liquid into chamber 13 in an initial tangential direction and then around the periphery of the inner surface of dome-shaped housing 12, in combination with the discharge of draining of liquid from vortex chamber 13 through drain openings 51, creates the liquid vortex 77 (FIG. 15) which simulates a tornado hovering over the landscape of base 14.

The formed vortex 77 will be maintained for a predetermined duration of time until nearly all of the liquid 73 within upper chamber 23 has been forcibly pumped therefrom by plunger pad 65 and until the created whirlpool-like turbulence formed in the liquid of chamber 13 subsides. The bubbles which are created by the foaming agent in liquid 73 increase the visual effect of the created vortex more than if the liquid were clear and free of such foaming agent matter. Other types of vortex indicators, such as oil, small solid particles of charcoal dust, metal or plastic powder, also would increase the visual effect of the produced vortex, but were found less satisfactory due to undesirable side effects than the water-foaming agent solution 73.

Figure 17:
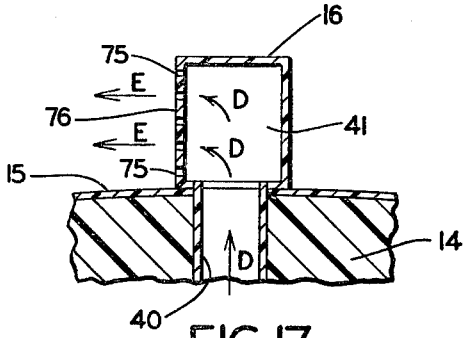
FIG. 17 is an enlarged fragmentary sectional view taken on line 17—17, FIG. 15.

A portion of the liquid pumped from upper chamber 23 into inlet duct 35 flows through fluid passage 40 into hollow interior 41 of simulated house 16, indicated by arrows D, FIGS. 12 and 17. This liquid is discharged from the interior of simulated house 16 through a plurality of pin holes 75 formed in housing end wall 76, as indicated by arrows E, to create a boundary layer control effect. Without boundary layer control at or near the downstream side of house 16 and tree 17, vortex 77 would not form properly due to the turbulence which is created by the swirling liquid striking the upstanding simulated house and tree. In order to use three-dimensional scene-creating objects (such as house 16 and tree 17) without this boundary layer control, the size of the house and tree would have to be greatly decreased, or else the strength of the liquid pumping action must be greatly increased. Otherwise, the vortex would not form properly nor would it remain formed for the desired length of time .

Two types of boundary layer controls were tested. The first was the creation of a suction at the downstream side of the house and tree to remove the turbulent boundary layer. The second was the injection of water from the downstream side of the house to energize the boundary layer. The injection method which is achieved by the discharge of liquid from house 16 as described above, provides a more satisfactory result than the suction method.

The use of a plurality of pinhole-like drain holes 51, in contrast to a single large drain hole of equal drain area, provides a vortex which is broader at the base than would be provided by a single drain hole. Also, drain holes 51 help to prevent the bubbles from being sucked out of the vortex and down the drain. Pinholes 51 are easier to disguise in the simulated landscape painted on base surface 15 than if a single large drain hole were used. Likewise, holes 51 allow vortex 77 to move around in the general area of the pinholes rather than being confined to draining down a single large hole, which adds to the visual effect created by the swirling vortex. Dome-shaped vortex housing 12, as opposed to other housing configurations, magnifies the created vortex and landscape scene depicted therein, increasing the visual effect created thereby.

Vortex housing 12 may have other configurations than the dome shape described above and shown in the drawings, such as rectangular, hexagonal, and elliptical horizontal cross sections. These shapes enable a vortex to be formed but the circular cross section of housing 12 is believed to be the most efficient. Also, discharge passage 43 and discharge space 42 need not be at the bottom of vortex chamber 13 as shown in the drawings, and may be near the top of the chamber or somewhere in between without affecting the desired results. Furthermore, drain 50–51 may be at the top of vortex chamber 13 and communicate with lower storage chamber 22 by a connecting tube or the like without affecting device 1.

Accordingly, tornado novelty device 1 provides a construction which is relatively simple, effective, safe, inexpensive and efficient, which achieves the enumerated objectives and provides a unique and interesting visual effect in a manner not believed accomplished by prior devices.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved tornado novelty device is constructed, assembled and operated, the characteristics of the new construction, and the advantageous, new and useful results obtained; the new and useful structures, devices, elements, arrangements, parts, and combinations are set forth in the appended claims.

I claim:

1. A novelty device which when inverted and vigorously shaken and then replaced right side up produces a simulated tornado in a liquid-filled chamber, said device including:

(a) a first chamber containing a predetermined quantity of liquid;

(b) a second chamber communicating with the first chamber;

(c) one-way valve means providing the communication between the first and second chambers and permitting the flow of liquid from the first chamber into the second chamber when the device is placed in an inverted position and preventing the return of the liquid from the second chamber back into the first chamber when the device is replaced right side up;

(d) a vortex chamber filled with a liquid providing the liquid-filled chamber in which the simulated tornado is produced;

(e) liquid inlet passage means extending between the second chamber and the vortex chamber for supplying liquid under pressure from said second chamber into the vortex chamber after the device is returned from its inverted position to an upright position; and (f) drain means extending between the vortex chamber and the first chamber for draining liquid from said vortex chamber into the first chamber when the device is replaced in an upright position, said liquid being forced by a siphonal action from the second chamber through the inlet passage means and into the vortex chamber in a tangential direction to form a vortex which simulates a tornado in the liquid in the vortex chamber in communication with the drain means.

2. The device defined in claim 1 in which a foaming agent is dissolved in the liquid and produces a quantity of bubbles when the device is vigorously shaken to provide a vortex indicator.

3. The device defined in claim 2 in which the foaming agent is sodium laureth-7 sulfate.

4. The device defined in claim 2 in which partition means is formed in the liquid inlet passage means to reduce the quantity of bubbles flowing from the vortex chamber into the second chamber when the device is placed in an inverted position and shaken.

5. The device defined in claim 2 in which partition means is formed in the drain means reducing the quantity of bubbles flowing from the vortex chamber into the first chamber.

6. The device defined in claim 1 in which pump means is operatively engaged with the second chamber for increasing the force of the liquid being discharged therefrom into the vortex chamber to strengthen the vortex produced in said vortex chamber.

7. The device defined in claim 6 in which the pump means includes a plunger operatively engageable with the second chamber to decrease the volume of said second chamber to expel liquid contained therein; and in which spring means biases the plunger toward engagement with the second chamber.

8. The device defined in claim 7 in which the second chamber is formed by a flexible bag; and in which the plunger has a pad which presses against the flexible bag to compress the second chamber formed therein to pump the liquid from said chamber.

9. The device defined in claim 1 in which the vortex chamber is formed within a rigid transparent housing having a circular horizontal cross-sectional configuration; in which the housing has a base; and in which the outlet drain means is formed centrally in the vortex housing base and the inlet means is formed tangentially in the periphery of said base.

10. The device defined in claim 9 in which a portion of the base is spaced from the vortex chamber housing forming a curved liquid inlet zone therebetween which communicates with the inlet means.

11. The device defined in claim 9 in which the vortex housing base has a top surface; in which a three-dimensional simulated structure is mounted on the base surface; and in which a liquid passage extends between the inlet means and the structure to inject liquid from the downstream side of the structure into the flow of liquid from the inlet means to prevent destruction of the formed vortex by said structure.

12. The device defined in claim 11 in which the simulated structure has a plurality of walls forming a hollow interior; in which the liquid passage communicates with the hollow interior of the structure; and in which a plurality of holes are formed in one of the structure walls through which liquid is injected into the flow of liquid in the vortex chamber.

13. The device defined in claim 9 in which the outlet drain means is formed by a plurality of closely grouped pinholes formed in the vortex housing base.

14. The device defined in claim 1 in which the valve means is a one-way check valve formed by a rigid tubular member which extends between and communicates with the interiors of the first and second chambers, and a collapsible flexible tubular member mounted on an end of the rigid tubular member and located within the second chamber.

15. The device defined in claim 1 in which the first and second chambers are formed by a flexible liquidproof bag divided into lower and upper compartments by a seam extending across the central portion of the bag; and in which the lower compartment forms the first chamber and the upper compartment forms the second chamber.

16. The device defined in claim 15 in which the bag is formed of a vinyl-type plastic material.

17. The device defined in claim 1 in which the first and second chambers are formed by a flexible bag of liquidproof material divided into said chambers by a horizontally extending seam; in which said bag is contained in a housing formed of a rigid, opaque material; and in which the vortex chamber is formed by a transparent dome-shaped housing mounted on top of the bag housing.

18. The device defined in claim 17 in which lever-spring-actuated pump means is located in the bag housing and operatively engages the second chamber to forcibly expel the liquid contained therein into the vortex chamber after the device has been replaced in an upright position by collapsing the flexible bag.

* * * * *